US006581232B1

(12) United States Patent
Chandler

(10) Patent No.: US 6,581,232 B1
(45) Date of Patent: Jun. 24, 2003

(54) POOL CLEANING APPARATUS

(76) Inventor: Michael John Chandler, 2 Downash House, Rosemary Lane, Flimwell, Wadhurst, East Sussex TN5 7PS (GB)

( * ) Notice: Subject to any disclaimer, the term of this patent is extended or adjusted under 35 U.S.C. 154(b) by 0 days.

(21) Appl. No.: 09/355,986

(22) PCT Filed: Feb. 6, 1998

(86) PCT No.: PCT/GB98/00377

§ 371 (c)(1),
(2), (4) Date: Jun. 26, 2000

(87) PCT Pub. No.: WO98/38405

PCT Pub. Date: Sep. 3, 1998

(30) Foreign Application Priority Data

Feb. 26, 1997 (GB) ..... 9704012

(51) Int. Cl.[7] ..... E04H 4/16

(52) U.S. Cl. ..... 15/1.7; 15/246; 15/404; 137/624.14; 137/624.15; 137/624.16; 137/624.17

(58) Field of Search ..... 15/1.7, 246, 404; 137/624.14–624.17

(56) References Cited

U.S. PATENT DOCUMENTS 4,023,227 A * 5/1977 Chauvier ..... 15/1.7
4,615,802 A * 10/1986 Harbaugh ..... 210/169
4,651,376 A * 3/1987 Ford ..... 15/1.7
4,675,921 A * 6/1987 Jean-Jacques ..... 4/490
4,837,886 A * 6/1989 Rawlins ..... 15/1.7

FOREIGN PATENT DOCUMENTS

FR 2604351 A * 4/1988 ..... A47L/7/04

* cited by examiner

*Primary Examiner*—Robert J. Warden, Sr.
*Assistant Examiner*—S Balsis
(74) *Attorney, Agent, or Firm*—Bacon & Thomas, PLLC

(57) ABSTRACT

Apparatus for use with automatic pool cleaners includes a tube which defines a flow channel for water drawn pump from the pool through a house by a remote pump. The tube includes tubular sections (10A, 10B) joined by a joint (11) which operates to move one tube section between first and second angularly displaced positions. Means are provided for periodically causing the movable tube section to move about the joint with sufficient force to impart movement to the hose to cause a change in direction of the cleaner.

6 Claims, 7 Drawing Sheets

POOL CLEANING APPARATUS

BACKGROUND OF THE INVENTION

1. Field of Art

This invention relates to automatic cleaners for swimming pools and apparatus for use therewith.

2. Description of Prior Art

Pool cleaners which automatically traverse the floor of a pool to clean the same are well known. These cleaners generally include a head mounted on a pad, feet or wheels and are connected via a suction pipe and flexible hose to a remote pump of a water recirculation system including filters to remove dirt and other debris from the pool water. Water is drawn through a flow channel formed in the cleaner head in communication with the suction pipe and movement of this flow of water through the flow channel is employed to impart motion to one or more devices which operate to cause the cleaner to traverse the pool floor.

In one particular type of automatic pool cleaner, movement of the water through the cleaner head induces a vibratory or pulsating movement to the head substantially in line with the cleaner's suction pipe. These pulses occur several times per second and impart vibratory movements to the suction pipe and the hose. An example of this type of automatic cleaner is disclosed in EP-A-0543387. Another type of automatic cleaner has a head mounted mini turbine which is driven by water as it is drawn through the flow channel by the pump. The turbine operates flaps or feet which propel the cleaner along the pool floor. An example of this type of cleaner is disclosed in GB-A-2181339.

One major problem with automatic cleaners is a tendency for them to become trapped in pool corners or by pool steps or wall fittings. When this happens the cleaners are unable to change direction. Their cleaning action is therefore discontinued.

An additional problem is that the hose often restricts movements to a series of eclipses or Figures of eight; when this occurs, areas of pools are uncleaned.

The present invention sets out to provide apparatus which overcomes or at least alleviates these problems.

SUMMARY OF THE INVENTION

According to the present invention in one aspect there is provided apparatus for use with automatic pool cleaners, the apparatus including a tube which defines flow channel for water drawn from the pool through a hose by a remote pump, the apparatus being characterised in that the tube includes an upper tubular section to which the hose is connected, a lower tubular section connected through a pivot to the upper tubular section, and a tubular ball joint through which water drawn from the pool passes from the lower tubular section to the upper tubular section and about which the upper tubular section can move relative to the lower tubular section, and means connected to the upper tubular section for periodically imparting movement to the upper tubular section thereby to move the upper tubular section and the hose connected thereto between first and second angularly displaced positions.

The joint may be an articulated joint.

DETAILED DESCRIPTION OF THE DRAWINGS

The invention will now be described by way of example only with reference to the accompanying diagrammatic drawings in which:

FIG. 1 diagrammatically illustrates a conventional automatic pool cleaner;

DETAILED DESCRIPTION OF THE INVENTION

Figure 1:
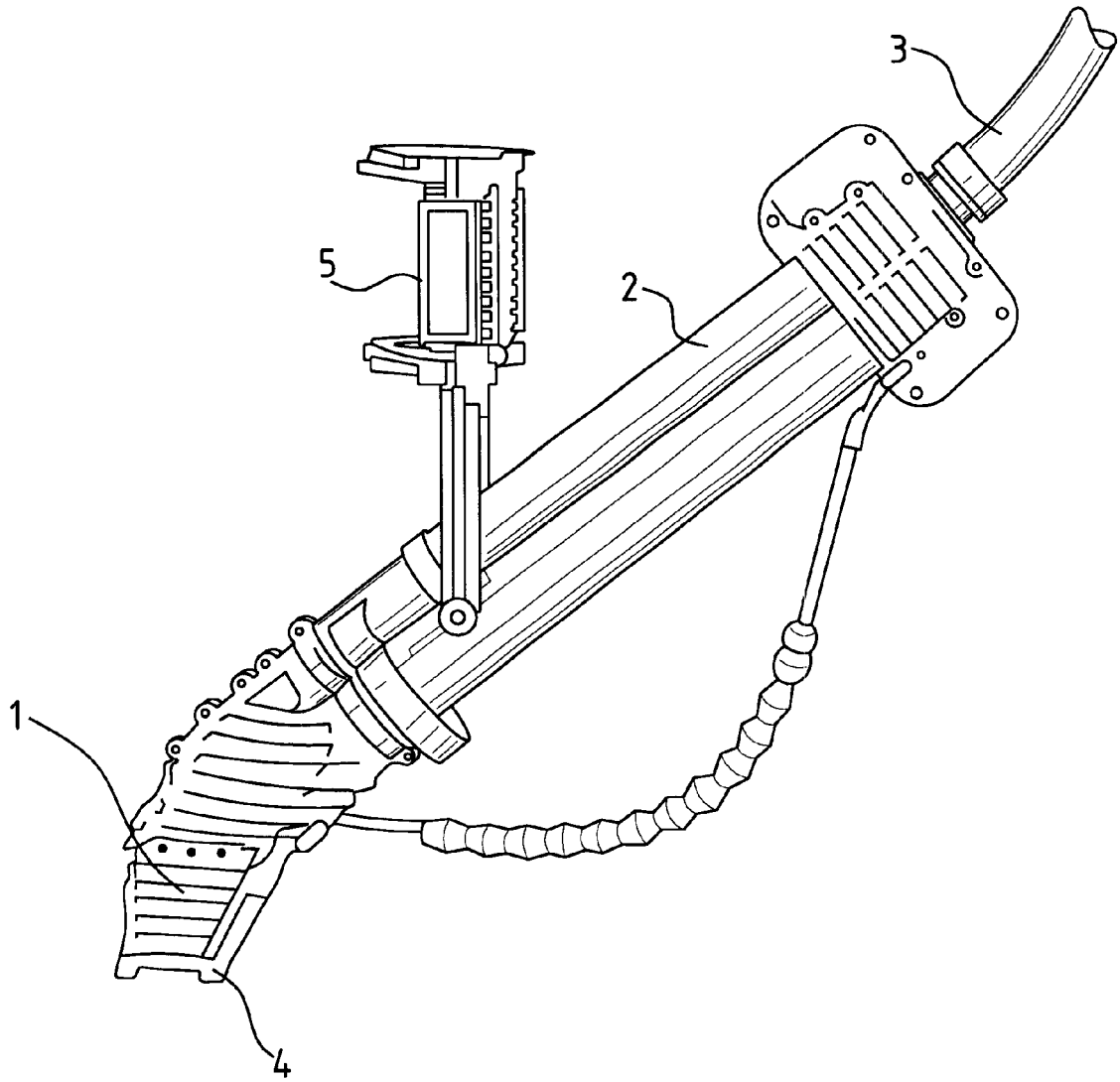

The conventional automatic pool cleaner illustrated in FIG. 1 comprises a head 1 connected through a suction pipe 2 to a hose 3 which is in turn connected to a remote pump (not shown) operable to effect recirculation of water drawn from the pool through filters for removing dirt and debris from the recirculated water. The head 1 is spaced from the pool floor by a foot pad and suction seal 4. A float 5 is employed to provide buoyancy. The cleaner illustrated is one known in the trade as a KREEPY KRAULY®.

Water drawn from the pool by the pump enters a flow channel formed in the head which communicates with the suction pipe 2. Pulses are created in the water passing through the flow channel to propel the cleaner along the pool floor. The pulses cause the suction pipe 2 to vibrate in a direction coincident with its longitudinal axis. Typically, vibrations occur at a frequency of the order of 5 to 7 vibrations per second, the movement engendered during each vibration being of the order of 5 mm to 10 mm.

Movement of the cleaner over the pool floor ceases in the event that the head becomes trapped, for example, within a corner of the pool or by pool steps or wall fittings. With current cleaners, the cleaner will remain trapped unless or until the cleaner, the hose or the suction pipe is moved manually.

The apparatus illustrated in FIGS. 2 to 12 of the drawings will now be described in the context of the pool cleaner illustrated in FIG. 1. It will be understood however that apparatus in accordance with the invention can be employed with other types of automatic pool cleaners and is not limited to the type of cleaner illustrated in FIG. 1.

Figure 2:
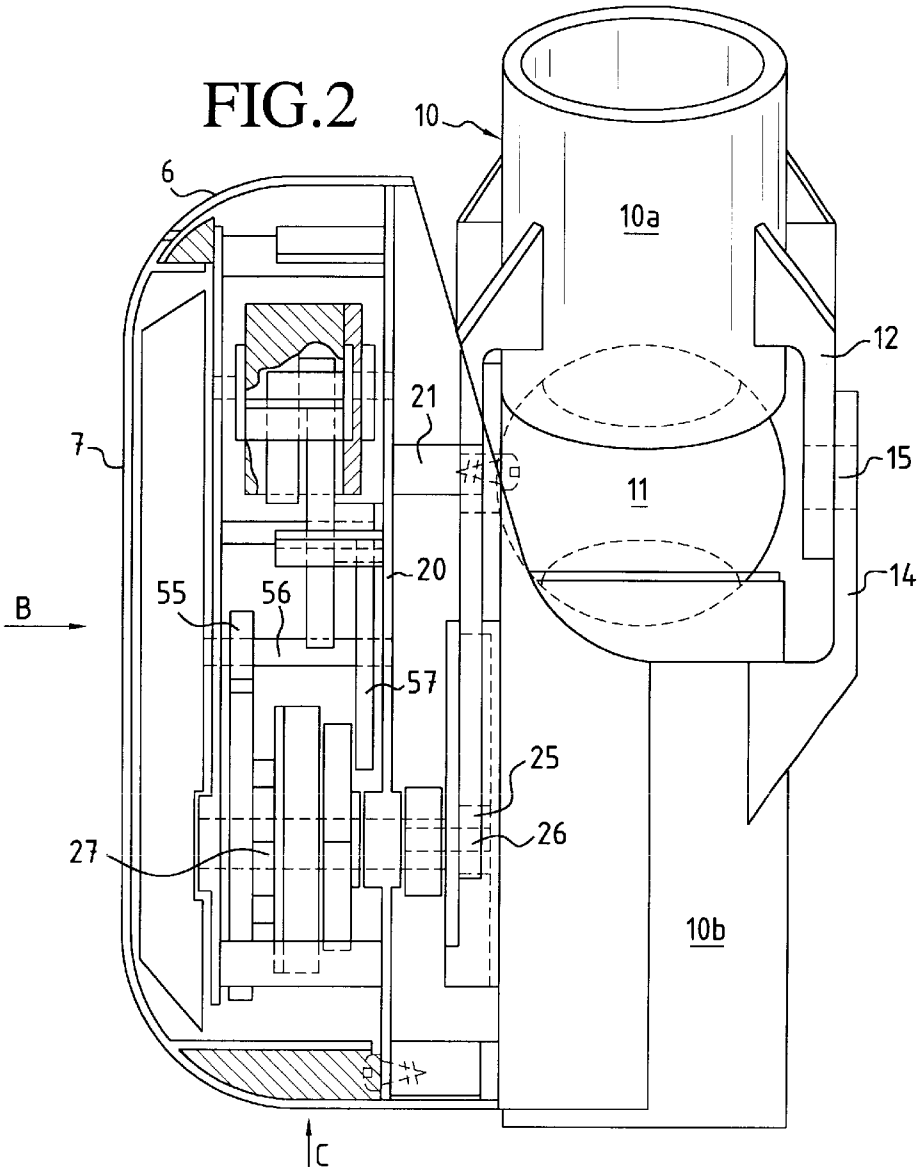
FIG. 2 is a side view partly in section of apparatus in accordance with the invention.

The apparatus illustrated in FIG. 2 comprises a pipe 10 connectable between the suction pipe 2 and hose 3 of the cleaner illustrated in FIG. 1. A gear assembly 6 is housed within a removable housing 7 and is secured to the side of the pipe 10. This gear assembly will be described in more detail below. As will be seen more clearly from FIGS. 3 to 6, the pipe 10 is divided into upper and lower sections 10*a*, 10*b* respectively separated by an articulated tubular ball joint 11. The joint 11 is retained between a yoke 12 secured to the upper pipe section 10*a* and a fork 14 secured to the lower pipe section 10*b*. The fork 14 is shown by itself in FIG. 4 and the yoke 12 in FIGS. 5 and 6. The yoke is connected to the fork 14 through pivots 15 (see FIGS. 3 and 5). The pipe sections 10*a*, 10*b* are accordingly, angularly displaceable about the pivots 15 through their connections to the yoke 12 and fork 14.

Figure 8:
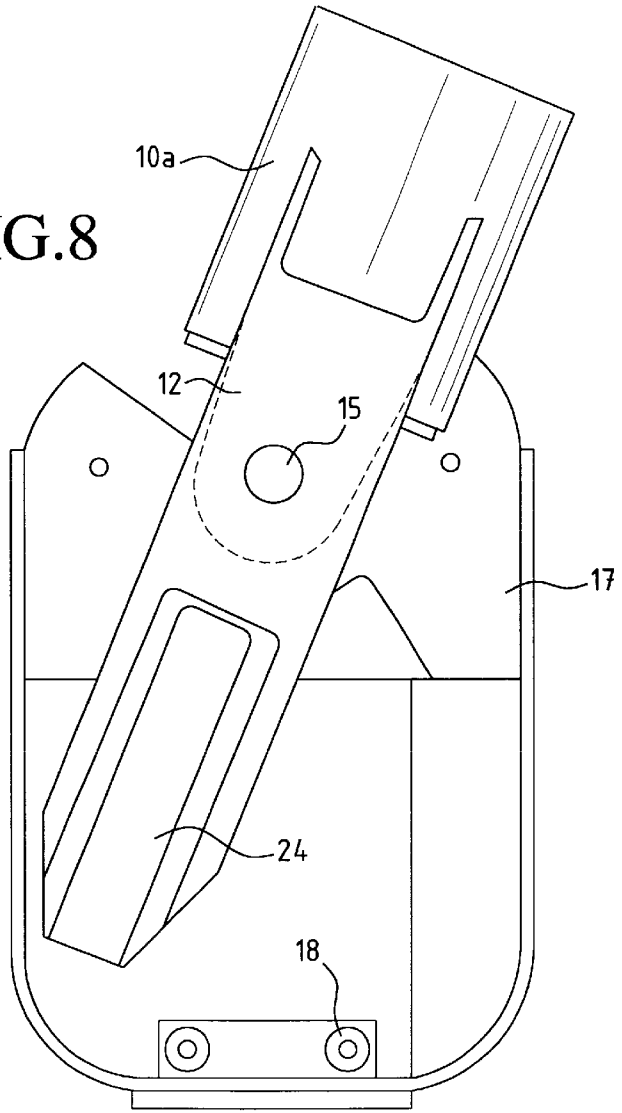
FIG. 8 shows the yoke of FIGS. 5 and 6 attached to the body portion of the fork of FIG. 7.
Figure 4:
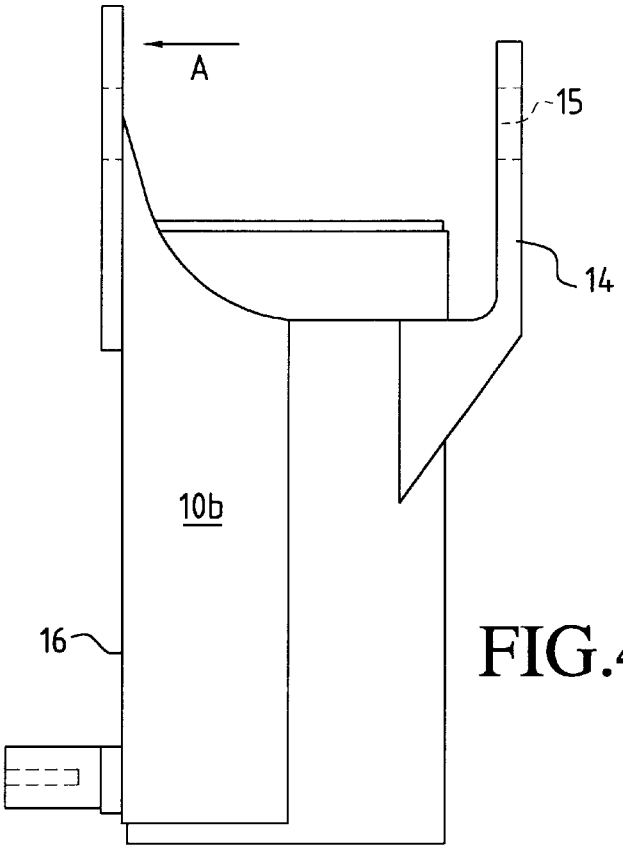
FIG. 4 is a side view of a fork of the flow pipe shown in FIG. 3.
Figure 7:
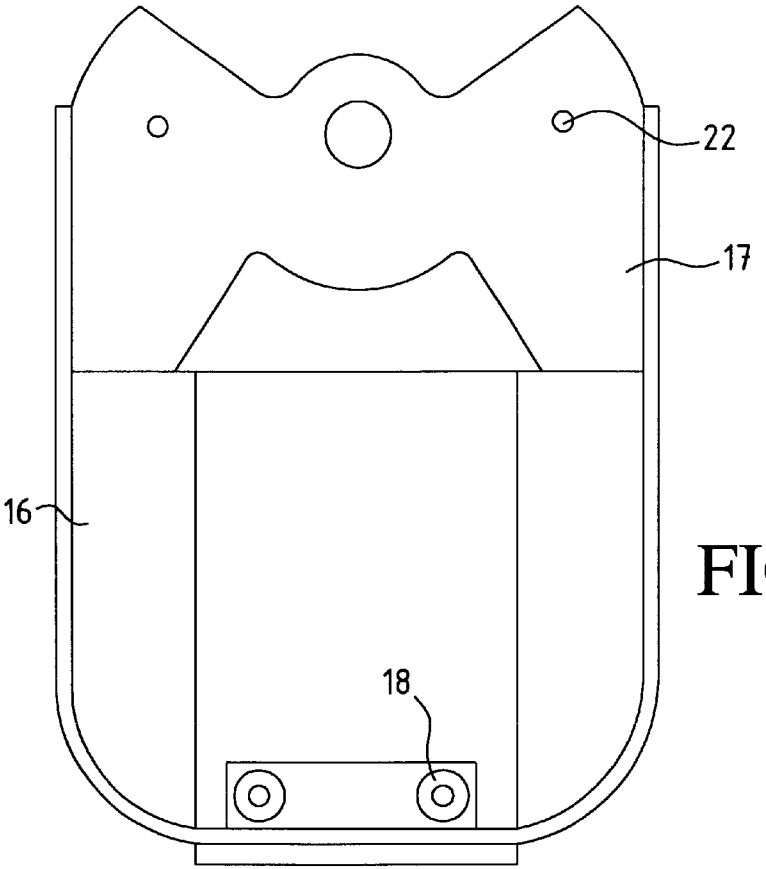
FIG. 7 is a view taken in the direction of arrow A of a body portion of the fork shown in FIG. 4.
Figure 6:
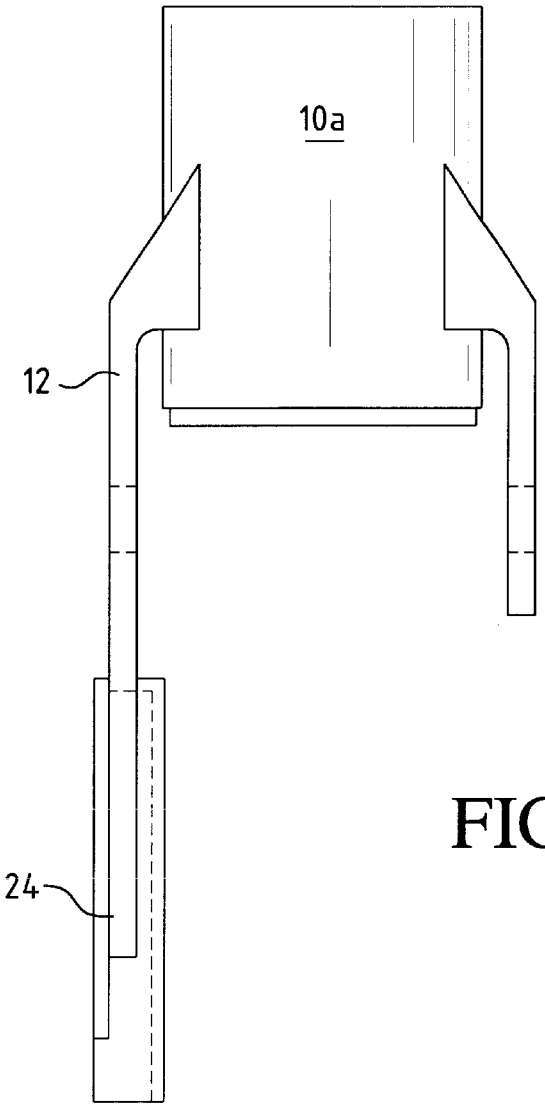
FIGS. 5 and 6 are side views one taken normal to the other of a yoke of the flow pipe shown in FIG. 3.
Figure 5:
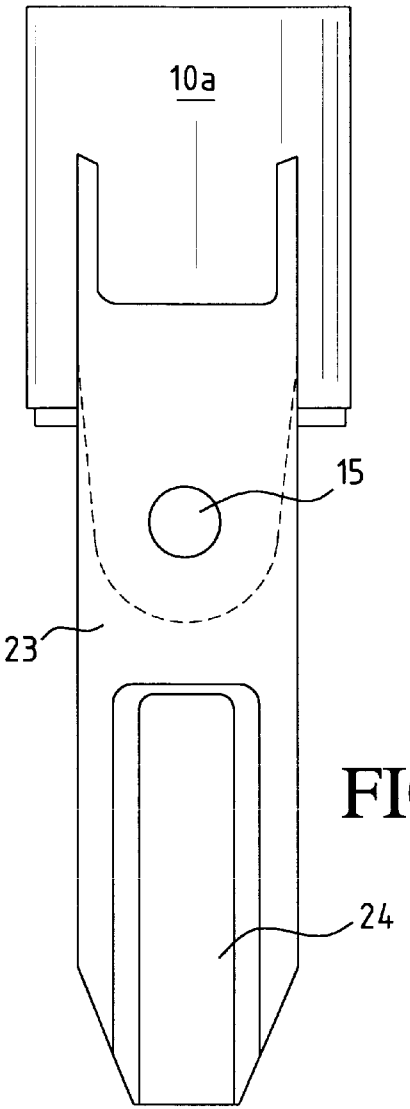

The fork 14 has a body portion 16 through which one of the pivots 15 extends. The face 17 of the body portion 16 remote from the joint 11 is shown in FIG. 7. The connection between the body portion and the yoke 12 is illustrated in FIG. 8. The face 17 carries spacers 18 which are internally threaded and cooperate with screw holes formed in an adjoining face of a support plate 20 of the gear assembly 6. The plate 20 carries spacers 21 which are also internally threaded and cooperate with screw holes 22 formed in the face 17 of the body 16.

One arm 23 of the yoke 12 extends downwardly into the space defined between the opposed body 16 and the plate 20 and includes an open-ended channel 24. This channel can be seen clearly from FIGS. 5 and 8.

Also positioned within the space defined between the body 16 and the plate 20 is a roller 25 carried by a drive arm 26 mounted for pivotal movement on one end of a shaft 27 which protrudes through the support plate 20. These members are illustrated in FIGS. 2 and 11 of the drawings.

The drive arm 26 is secured to the shaft 27 by a transverse pin. The roller 25 locates within the channel 24.

The face of the plate 20 remote from the drive arm 25 supports a series of gears, springs, cams and cam followers which will now be described.

Figure 11:
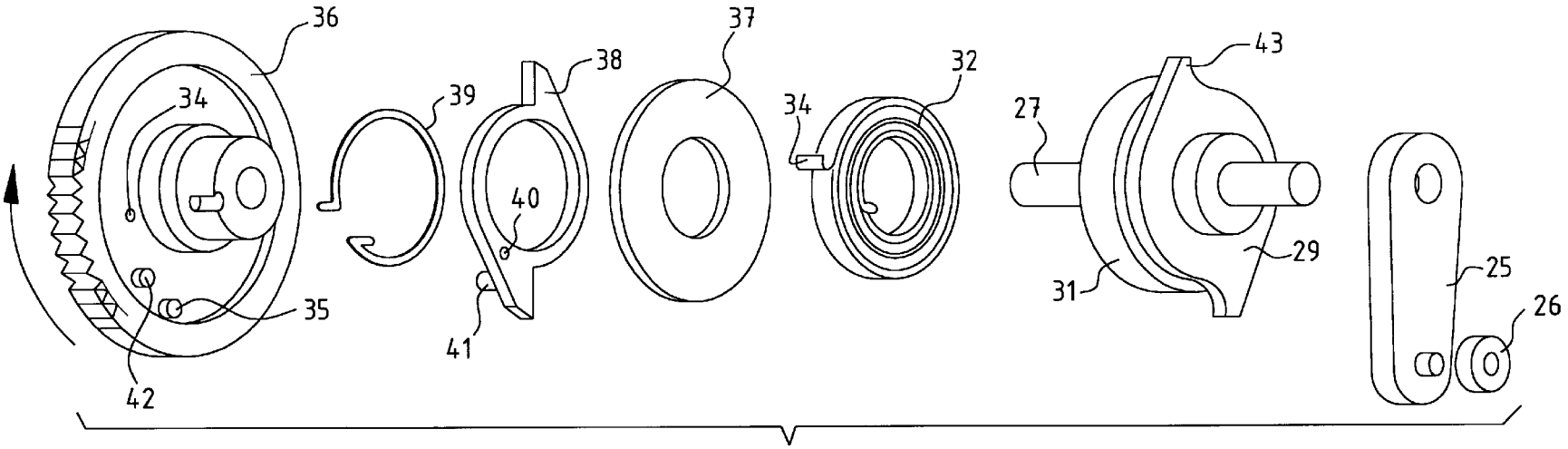
FIG. 11 is an exploded view of a part of the gear assembly shown in FIG. 9.
Figure 12:
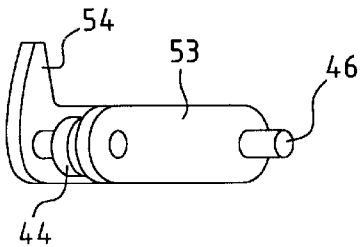
FIG. 12 is a side view of a spring biased stop shown in FIG. 10.

As will be seen more clearly from FIG. 11, the shaft 27 carries a twin lobed stop 29 and a drum 31 in which is wound a coil spring 32. One end of the spring 32 is secured to the drum 31 and its other end 34 engages a stop 35 of an input gear 36 whereby movement of the gear coils and therefore tensions the spring 32. An annular cover 37 is provided for the drum 31 to retain the spring 32. A twin lobed cam 38 is positioned between the drum cover 37 and one face of the input gear 36. A return spring 39 is connected at one end to the cam 38 via an aperture 40 and at its other end to the input gear 36 via an aperture 34. The cam 38 has a stop 41 projecting from its surface which engages and is moved by a complementary stop 42 projecting from one face surface of the input gear 36. Thus, movement of the input gear 36 drives the cam 38 and at the same time tensions the coil spring 32. Movement of the drum 31 relative to the cam 38 tensions the return spring 39.

Figure 9:
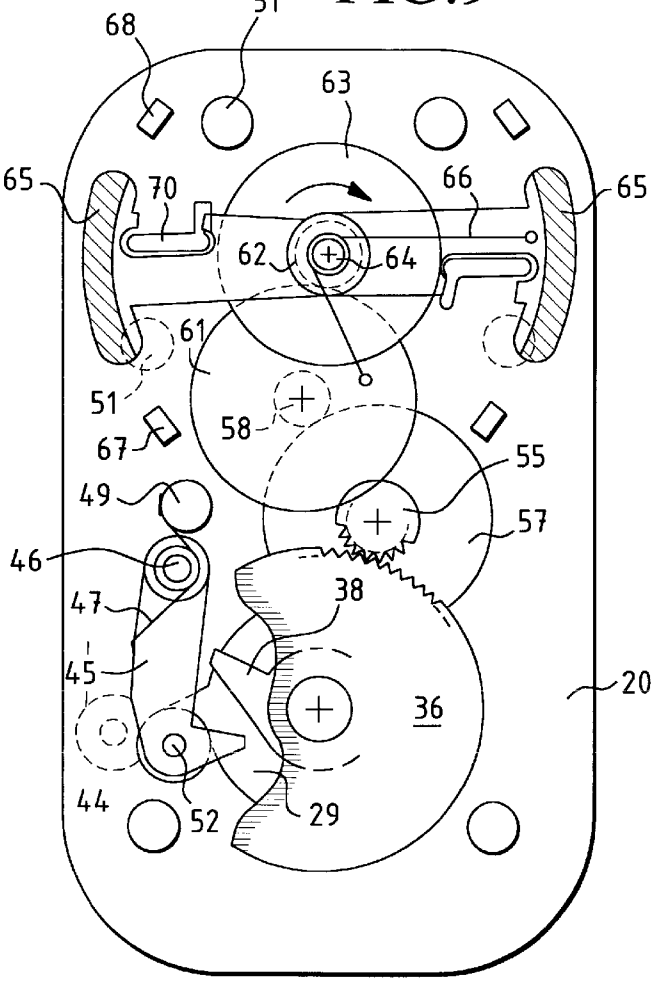
FIG. 9 is a plan view of a gear assembly of the apparatus shown in FIG. 2 with the gear assembly housing removed, the plan view being taken in the direction of arrow B of FIG. 2.
Figure 3:
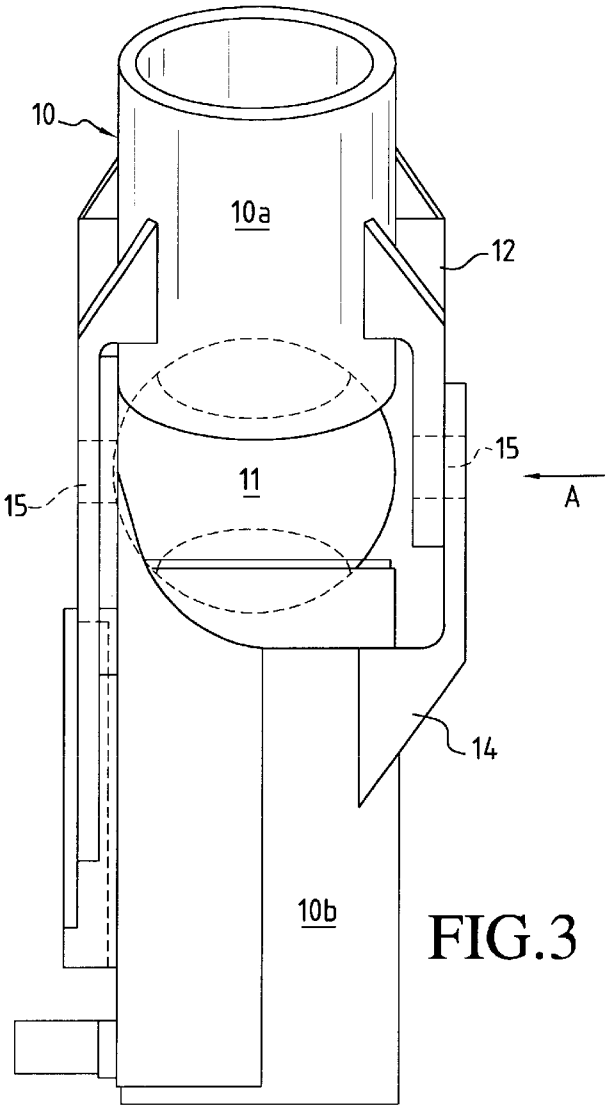
FIG. 3 is a side view of an articulated flow pipe of the apparatus shown in FIG. 2 with a gear assembly of the apparatus moved.

One lobe 43 of the stop 29 in FIG. 11 is located behind an annular roller 44, shown in FIG. 9, carried on one end of a spring loaded stop assembly 45 mounted for pivotable movement about a spindle 46. The stop assembly 45 is urged towards the stop 29 and the cam 38 by a spring 47 which is wound about a projection of the stop assembly 45 and engages at one end an outer edge of the stop assembly and at its other end a spacer 49 to which a cover plate of the gear assembly is attached. Additional spacers to which the cover plate is attached are provided.

The roller 44 is mounted for rotation on a pin 52 which extends between spaced upper and lower arms 53 of the stop assembly 45. The roller 44 defines a stop which seats behind a profiled surface of the lobes 43 of the stop 29. The profiled surface of the lobe is curved to complement the circumference of the roller. The roller is carried by the lower arm of the assembly 45. The free end of the upper arm of the assembly is shaped to define a cam follower tip 54 (see FIG. 12) which is contacted and therefore moved by the cam lobes as the cam 38 rotates. Thus, rotation of the cam 38 causes the cam follower tip 54 of the stop assembly to rotate about the spindle 46.

Figure 10:
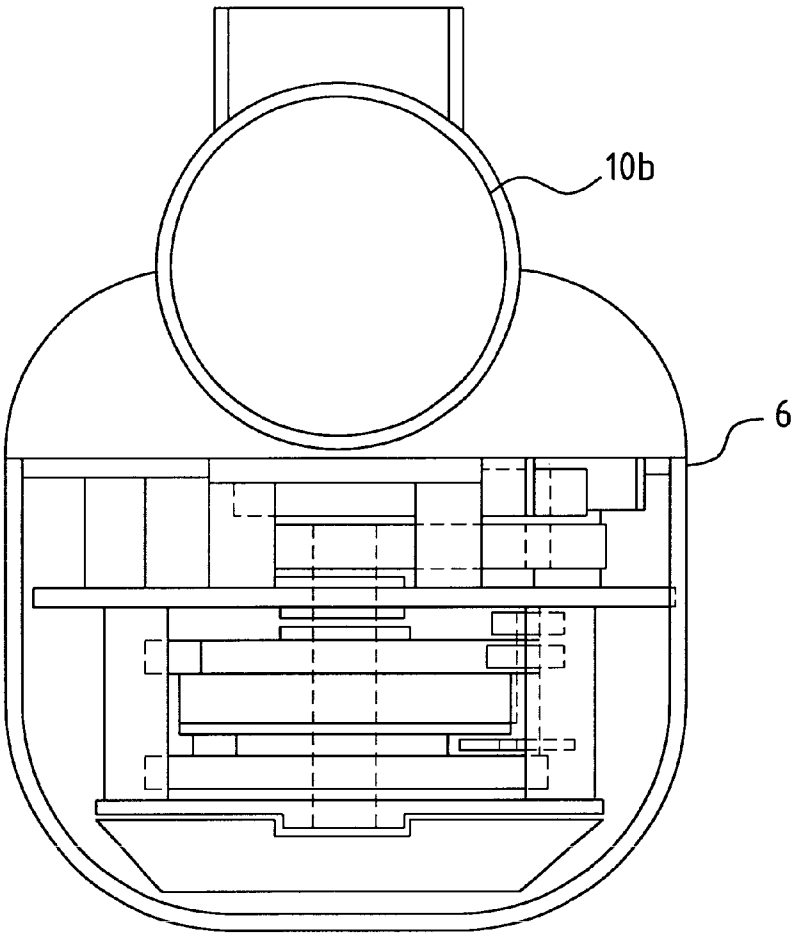
FIG. 10 is a view of the gear assembly shown in FIG. 9 taken in the direction of arrow C of FIG. 2.

As will be seen from FIGS. 2, 9 and 10, the input gear 36 is driven by a gear pinion 55 mounted on a shaft 56 to which is secured a gear 57 driven by a pinion gear 58 mounted on a shaft. A shaft also carries a gear 61 which meshes and is driven by a pinion gear 62 to which is secured a disc 63. Pinion gear 62 is mounted on a shaft 64.

A pair of spring biased weighted pivotable swing members 65 are rotatably carried by the shaft 64 and are movable against the action of springs 66 in arcs confined by two of the spacers 51 and by stops 67, 68. Arcuate movements of the swing members 65 are generated by reciprocating movements of the suction pipe to which the pipe 10 is connected. Eccentric cams 70 provide a pawl action to turn the disc 63, and the arcuate movements of the members 65 cause the shaft 64 and pinion gear 62 to rotate. The cams 70 ensure hat the shaft 64 always rotates in the same direction.

In use, the arcuate movements of the swing members 65 impart rotational movement to the pinion gear 62 and, through the gears 61, 58, 57 and 55, to the input gear 36. Rotational movement of input gear 36 progressively moves the twin lobed cam 38 with the cam follower tip 54 periodically making contact with the cam lobes. When the tip 54 engages one of the cam lobes, the stop assembly 45 is moved to release the lobe of the stop 29 from its engagement with the roller 44. The stop 29 is then swiftly rotated by the action of the coil spring 32 through a half revolution until the other lobe engages the roller which by this time has been moved towards the stop 29 by spring pressure. The cam 38 is returned to its original position by the return spring 39.

Rotation of the stop 29 drives the roller 25 of the drive arm along the channel 24 to cause the pipe section 10A to move to the angular displaced position shown in broken line. This movement is sufficient to cause the hose 3 to flip over thereby changing the direction of force applied to the cleaner to enable the cleaner to change direction.

The illustrated apparatus is encased within a removable housing and is preferably lined with, or includes, a flotation pad which effectively neutralises the weight of the apparatus when it is immersed in water.

It will be appreciated that the foregoing is simply exemplary of apparatus in accordance with the invention and that modifications can readily be made thereto without departing from the true scope of the invention as set out in the appended claims. Thus the joint 11 may simply comprise a flexible tubular connection between the pipe sections 10A, 10B. Alternatively, the pipe section 10A may include an inclined section, the joint being located between the adjoining generally straight pipe sections. Also, the pipe sections may be inclined mutually whereby rotation of one section causes the required angular displacement. Also, the mechanism for causing one pipe section to be angularly displaced may differ from that described. Thus, a time-operated mechanism may be employed.

What is claimed is:

1. Apparatus for use with automatic pool cleaners including a tube which defines a flow channel for water drawn from a pool and includes an upper tubular section, a lower tubular section connected through a pivot to the upper tubular section, and a tubular ball joint through which water drawn from the pool passes from the lower tubular section to the upper tubular section and about which the upper tubular section can move relative to the lower tubular section, means connected to the upper tubular section for periodically imparting movement to the upper tubular section thereby to move the upper tubular section between first and second angularly displaced positions with respect to the lower tubular section, and a gear assembly whose housing is spaced from but secured to the lower tubular section, the gear assembly operating to move the upper tubular section between the first and second angularly displaced positions.

2. Apparatus as claimed in claim 1 wherein the joint is articulated.

3. Apparatus as claimed in claim 1 wherein the upper tubular section includes an arm formed with an open ended channel into which a roller is positioned, the roller being mounted on a drive arm which is in turn mounted on a shaft of an input gear of the gear assembly.

4. Apparatus as claimed in claim 3 wherein the shaft supports a cam including one or more projecting lobes contactable by a drive member of the input gear.

5. Apparatus as claimed in claim 4 further comprising resilient means supported on the shaft and operable to tension a twin lobed stop which is released through contact with the lobes of the cam.

6. Apparatus as claimed in claim 5 wherein the cam is rotated by means of the gear assembly which is in turn driven by vertical displacements of the apparatus.

* * * * *